US005367366A

United States Patent [19]

Kido et al.

[11] Patent Number: 5,367,366

[45] Date of Patent: Nov. 22, 1994

[54] CORONA CHARGER FOR IMAGE FORMING APPARATUS PROVIDING UNIFORM SURFACE CHARGE OF A RECORDING MEDIUM

[75] Inventors: Eiichi Kido, Yamato-Koriyama; Yuhi Yui, Nabari; Syunju Anzai, Nara; Syoichiro Yoshiura, Yamato-Koriyama; Shinji Imagawa, Yao; Hiroaki Yoshida, Yamato-Koriyama; Yoshikazu Kawasaki, Kagoshima; Itaru Kawabata, Kashiba; Keizo Fukunaga, Ikoma; Toyokazu Mori, Yamato-Koriyama; Masaru Tsuji, Nara, all of Japan

[73] Assignee: Sharp Kabushiki Kaisha, Osaka, Japan

[21] Appl. No.: 49,443

[22] Filed: Apr. 20, 1993

[30] Foreign Application Priority Data

Jun. 4, 1992 [JP] Japan ..... 4-170275
Jun. 26, 1992 [JP] Japan ..... 4-169133

[51] Int. Cl.[5] ..... G03G 15/02
[52] U.S. Cl. ..... 355/225; 355/224
[58] Field of Search ..... 355/219, 221, 222, 223, 355/224, 225; 361/225; 250/324, 325

[56] References Cited

U.S. PATENT DOCUMENTS

| | | | |
|---|---|---|---|
| 533,230 | 8/1885 | Fletcher et al. . | |
| 3,744,898 | 7/1973 | Kurahashi et al. | 355/224 |
| 3,811,048 | 5/1974 | Matsumoto et al. | 250/325 X |
| 4,591,713 | 5/1986 | Gundlach et al. . | |
| 4,725,731 | 2/1988 | Lang . | |
| 4,837,658 | 6/1989 | Reale | 361/225 X |
| 5,018,045 | 4/1991 | Myochin et al. | 355/221 X |
| 5,079,669 | 1/1992 | Williams . | |
| 5,087,944 | 2/1992 | Yamauchi | 355/225 |
| 5,250,992 | 10/1993 | Tsuneeda et al. | 355/221 |

FOREIGN PATENT DOCUMENTS

| | | |
|---|---|---|
| 0001886 | 5/1979 | European Pat. Off. . |
| 60-158582 | 8/1985 | Japan . |
| 61-46828 | 10/1986 | Japan . |
| 63-14176 | 1/1988 | Japan . |
| 63-15272 | 1/1988 | Japan . |
| 63-55566 | 3/1988 | Japan . |
| 63-172182 | 7/1988 | Japan . |
| 63-180977 | 7/1988 | Japan . |
| 3-252676 | 11/1991 | Japan . |

*Primary Examiner*—A. T. Grimley
*Assistant Examiner*—Nestor R. Ramirez

[57] ABSTRACT

A charger charges a recording medium before irradiation of light to form an electrostatic latent image by irradiating light as an optical image onto a surface of the recording medium. The charger includes a discharging electrode having a plurality of projections for generating corona discharge to charge the recording medium surface, a conductive shield case having an opening face opposite to the recording medium and opposed to the discharging electrode, a holding member for holding the discharging electrode in the shield case in a state in which the discharging electrode is electrically insulated from the shield case, a conductive grid electrode electrically insulated and held between the discharging electrode and the recording medium, and a power supplying device for supplying a high voltage for discharge to the discharging electrode and setting a ratio of electric currents flowing through the grid electrode and the shield case such that these electric currents are approximately equal to each other. One form of the charger controllably moves the discharger electrode toward the recording medium for setting the value of the electric currents flowing through the grid electrode and the shield case until they are both equal to a predetermined reference value.

7 Claims, 8 Drawing Sheets

CORONA CHARGER FOR IMAGE FORMING APPARATUS PROVIDING UNIFORM SURFACE CHARGE OF A RECORDING MEDIUM

BACKGROUND OF THE INVENTION

1. Field of the Invention

The present invention relates to a charger for charging or discharging a recording medium for forming an image in electrostatic electrophotography. More particularly, the present invention relates to a charger for uniformly charging a surface of a recording medium by corona discharge in an image forming apparatus such as a copying machine, a printer, etc., and having a discharging electrode having a plurality of projections in the direction of a rotational axis of the recording medium. The present invention further relates to a charger of an electrostatic electrophotographic system in which a current distribution ratio of electric currents flowing through an electrode of the charger and a grid electrode between this electrode and a photosensitive body can be adjusted and set to a predetermined current distribution ratio.

2. Description of the Related Art

As is well known, an image forming apparatus using an electrostatic electrophotographic system is constructed by processing sections of charge, exposure, development, transfer, separation, cleaning and discharge. Specifically, in a process for recording an image, a charger uniformly charges a surface of an image carrier as a recording medium formed on a conductive supporting body composed of e.g., an aluminum drum with respect to a rotated photoconductive layer. An optical image of an original image is next exposed onto the charged surface of the image carrier through an optical exposure device so that an electrostatic latent image according to this optical image is recorded on this carrier surface. Subsequently, toner is electrostatically attached to the electrostatic latent image on this image carrier and is then developed so that a toner image is formed on the image carrier surface. The toner image on the image carrier is then transferred onto a transfer material by a transfer device and is fixed by a fixing heater. Residual transfer toner left on the image carrier surface is removed therefrom by a cleaner and is collected in a predetermined collecting section. Residual charges are removed by a discharger from the image carrier surface after the cleaning operation to perform the next image forming operation.

For example, the recording medium as the image carrier is constructed by a photosensitive body in which an organic photo conductor (OPC) as the photoconductive layer is formed on the conductive drum. A corona discharger is generally used as a charger for providing charges for the surface of the recording medium in many cases.

In one corona discharger, a very thin conductive wire is covered with a conductive shield plate in a peripheral portion except for a shield portion opposite to the recording medium. A high voltage is applied to the wire so that corona discharge is caused to provide charges for charging by an electric current flooring through the recording medium. In another charger using corona discharge, a saw-toothed discharging electrode having many sharp projections arranged in line is utilized instead of the wire for corona discharge. A charging operation of this charger is performed by corona discharge from the sharp projections.

For example, the charger using the above saw-toothed discharging electrode (which is called a saw-toothed electrode in the following description) is proposed in specifications of the following patents.

(1) U.S. Pat. No. 4,591,713 (corresponding to Japanese Patent Application Laying Open (KOKAI) No. 60-158582)

(2) U.S. Pat. No. 4,725,731 (corresponding to Japanese Patent Application Laying Open (KOKAI) No. 63-14176)

(3) U.S. Pat. No. 4,725,732 (corresponding to Japanese Patent Application Laying Open (KOKAI) No. 63-15272)

(4) U.S. Pat. No. 4,792,680 (corresponding to Japanese Patent Application Laying Open (KOKAI) No. 63-180977)

In a typical charger, a surface of the photosensitive drum is uniformly charged by corona discharge in an axial direction of this drum. A charging condition is Slightly changed in accordance with various conditions of the corona discharge. When the charging condition is changed, charging irregularities on the surface of the photosensitive drum are caused so that the quality of an original image to be formed is influenced by the charging irregularities.

A method for increasing the total electric current flowing through saw-toothed electrodes is considered a simple method for reducing these charging irregularities, However, when the total electric current is increased, it is necessary to increase a voltage applied to the saw-toothed electrodes. A discharging electric current is increased when the voltage applied to the saw-toothed electrodes is increased. Therefore, the amount of ozone generated from a discharging portion is increased so that the surface of the photosensitive drum is influenced by this ozone, thereby reducing the quality of an original image.

When the amount of ozone is increased, the ozone is bonded to various gases and foreign materials in the air floating within an image forming apparatus so that nitrogen oxides ($NO_X$), silicon oxides ($SiO_2$), etc. are generated. These oxides are attached onto surfaces of the saw-toothed electrodes and the grid electrode so that discharging ability of the saw-toothed electrodes and ability for controlling a charging potential of the grid electrode are reduced.

Further, it is necessary to prevent leakage discharge from tip portions of the saw-toothed electrodes to other unnecessary portions by an increase in applied voltage by increasing the total electric current. To prevent this leakage discharge, it is necessary to provide excessive distances from discharging portions of the saw-toothed electrodes to a shield case. Therefore, the shield case becomes large-sized so that the charger becomes large-sized.

As is well known, a copying machine of an electrostatic electrophotographic system is constructed by unit processes of charge, exposure, development, transfer and fixing. Specifically, in a copying process, uniform charges are provided by a charger onto a surface of a photosensitive body. Reflected light of an original image is irradiated onto this photosensitive body surface through an optical system so that an electrostatic latent image is formed. This electrostatic latent image is developed by electrostatically attaching toner as developing powder to the electrostatic latent image so that a toner image is formed on the photosensitive body. The toner image is next transferred onto a piece of recording paper by static electricity of the photosensitive body as a transfer body and is thermally fixed onto the piece of recording paper as an image according to the original image.

The photosensitive body is constructed by using a material such as selenium having a high resistance and a high optical carrier generation rate. The charges on the photosensitive body are provided by corona discharge. A typical charger for generating the corona discharge is composed of a wire electrode charger and a saw-toothed electrode charger having a needle-shaped electrode.

In the wire electrode charger, a charging line is made of tungsten or stainless steel having a thickness of 25 to 90 μm (micrometers) and is tensioned within a charger case. The charger case is opened onto a side of the metallic photosensitive body through an insulator. The charging line is connected to a power source and corona discharge is generated from this charging line.

In contrast to the wire electrode charger having the charging line, the saw-toothed electrode charger has a saw-toothed electrode having a sharp tip portion and corona discharge is caused from this tip portion. In these chargers, a grid electrode having a predetermined potential is normally arranged between the photosensitive body and the charger to prevent a charging electric current from being changed.

It is desirable that the charger transfer uniform charges onto a photosensitive drum surface by the corona discharge. The corona discharge, however, is influenced by an external environment such as atmospheric pressure, temperature, humidity, etc. Further, an electrode current is changed by any wear of a tip portion of the saw-toothed electrode so that no photosensitive drum is uniformly charged with ionic charges. Any change in electrode current causes a change in impedance between the saw-toothed electrode and the photosensitive drum.

A grid current and a case electric current respectively flow through the grid electrode and the charger case by the corona discharge from the saw-toothed electrode. A ratio of the grid current to the case electric current is an impedance ratio and is constant in a normal operating state. However, this impedance ratio is changed in accordance with the above external environment and operating states of the electrodes.

The saw-toothed electrode is separated by a constant distance from the grid electrode and is fixed with respect to the photosensitive drum. Accordingly, when the impedance ratio is changed, charges on the photosensitive drum is not uniform and lack of uniformity on charges can not be corrected in a conventional charger.

SUMMARY OF THE INVENTION

It is therefore an object of the present invention to provide a charger for stabilizing the corona discharge using a saw-toothed electrode and performing a uniform changing operation without any discharging irregularities.

Another object of the present invention is to provide a charger in which problems concerning a large-sized structure of the charger, leak discharge, etc. are solved without increasing a voltage applied to a saw-toothed electrode and charging characteristics are stabilized at any time by effectively generating a corona flow to discharge ozone from the charger so that no operation of the charger is influenced by this ozone.

In accordance with a first embodiment of the present invention, the above objects are achieved by a charger for charging a recording medium before irradiation of light to form an electrostatic latent image by irradiating light as an optical image onto a surface of the recording medium; the charger comprising a discharging electrode having a plurality of projections for generating corona discharge to charge the recording medium surface; a conductive shield case having an opening face opposite to the recording medium and opposed to the discharging electrode; a holding member for holding the discharging electrode in the shield case in a state in which the discharging electrode is electrically insulated from the shield case; a conductive grid electrode electrically insulated and held between the discharging electrode and the recording medium; and a power supplying device for supplying a high voltage for discharge to the discharging electrode and including means for setting a ratio of electric currents flowing through the grid electrode and the shield case such that these electric currents are approximately equal to each other.

In accordance with a second embodiment of the present invention, the shield case comprises at least one conductive auxiliary electrode plate arranged in parallel with a longitudinal direction of the discharging electrode for charging the recording medium surface, and the auxiliary electrode plate is located in a region located on a side of the recording medium from a tip portion of the discharging electrode and is also located within a discharging region of the discharging electrode.

In accordance with a third embodiment of the present invention, a portion of the shield case is different in structure from the other portions of the shield case with respect to the discharging electrode for charging the recording medium surface, and a corona discharging portion on the recording medium surface is deflected in a predetermined direction.

In a charger in accordance with the present invention, when a high voltage for generating corona discharge is applied to the discharging electrode, the corona discharge is generated from a projecting portion of the discharging electrode. The total current of the corona discharge flows onto a side of the discharging electrode. At this time, a portion of the discharging electric current also flows onto the side of a recording medium so that a surface of the recording medium is charged with electricity having a predetermined polarity. In addition to the recording medium, a portion of the discharging current flows through the shield case and the grid electrode by the corona discharge.

In a first embodiment of the charger, a ratio of a case electric current flooring through the shield case and a grid current flowing through the grid electrode is set such that the case electric current and the grid current are approximately equal to each other. Therefore, a substantially uniform corona discharge is generated along an entire length of the discharging electrode in a longitudinal direction thereof. Accordingly, the entire recording medium can be uniformly charged without any charging irregularities. In particular, it is not necessary to increase the voltage applied to the discharging electrode.

In a second embodiment of the charger, the shield case is constructed by at least one auxiliary electrode plate. Accordingly, it is not necessary to entirely cover the discharging electrode with the shield case so that the charger can be cheaply manufactured and can be made compact. Since the corona discharge is caused on a front projecting tip face of the discharging electrode, the shield case can be especially used as the auxiliary electrode on at least this front face.

In a third embodiment of the charger, a portion of the shield case is different in structure from the other portions of the shield case so that a corona discharging direction can be deflected. Thus, the direction of a corona flow caused by the corona discharge is deflected so that ozone generated at a corona discharging time is discharged along this flow direction. In this instance, ozone can be easily discharged from the shield case by directing the corona discharging direction toward a position in which there are no other devices.

In accordance with a fourth embodiment of the present invention, the above objects are achieved by a charger in a copying machine of an electrostatic electrophotographic system characterized in that the charger comprises a photosensitive drum having a uniformly charged face; a corona discharger electrode for charging the photosensitive drum; a charger case for electrically insulating and storing the corona discharger electrode; a grid electrode arranged between the photosensitive drum and the corona discharger electrode; a power source for supplying an electric current to each of the grid electrode, the charger case and the corona discharger electrode; and means for moving the corona discharger electrode toward the photosensitive drum such that a distribution ratio of electric currents flowing through the grid electrode and the charger case is set to a predetermined value.

In accordance with a fifth embodiment of the present invention, the moving means comprises an electrode holding member located in the charger case; a movable electrode is electrically insulated and held in the electrode holding member such that the movable electrode can be moved with respect to the electrode holding member; and a manual operating device for moving the movable electrode forward and backward on a side of the photosensitive drum.

In accordance with a sixth embodiment of the present invention, the charger further comprises a case electric current detector for detecting a case electric current flowing through the charger case; a grid current detector for detecting a grid current; a distribution ratio discriminator for judging whether or not the current distribution ratio of the case electric current and the grid current is equal to a reference value based on detected electric currents of the case electric current detector and the grid current detector; a timing device for generating commands of a period for moving the corona discharge electrode; a shaft drive unit for driving a motor by outputs of the moving timing device and the distribution ratio discriminator; and a driving transmission mechanism connected to the motor and moving the corona discharger electrode such that the current distribution ratio is set to the reference value.

In this charger, an electrode current is changed by a change in impedance between the photosensitive drum and the corona discharger electrode, a saw-toothed electrode. When the electrode current is changed, a current distribution ratio of the grid current and the case electric current is changed by corona discharge. More particularly, the impedance between the grid electrode and the charger case is changed by the corona discharge. Accordingly, the saw-toothed electrode is moved toward the photosensitive drum to adjust a position of the saw-toothed electrode so as to provide a predetermined current distribution ratio of the grid current and the case electric current.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a charger in the present invention will next be described in detail with reference to the accompanying drawings.

Figure 1:
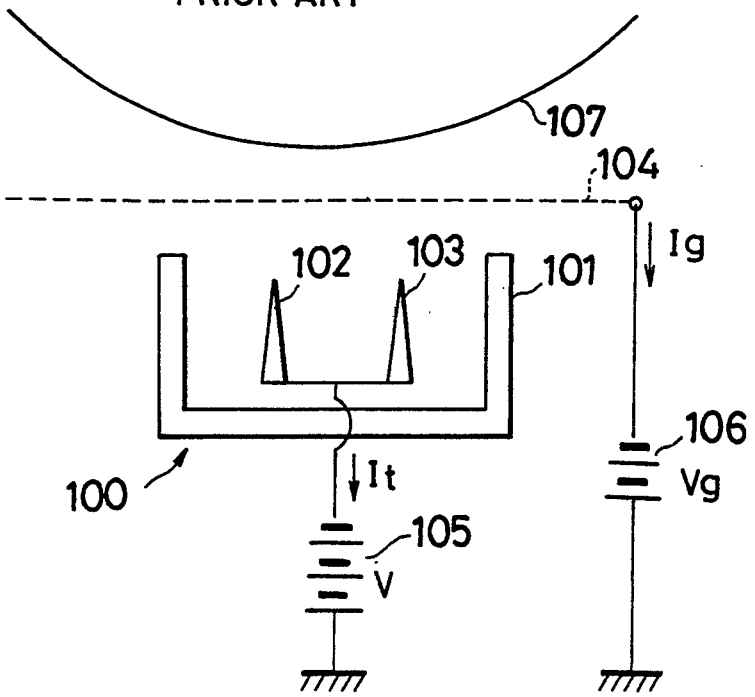
Fig. 1 PRIOR ART
FIG. 1 is a cross-sectional view showing a typical prior art charger.

FIG. 1 shows the schematic structure of a charger described in U.S. Pat. No. 4,591,713. Two saw-toothed electrodes 102 and 103 are parallel to each other and are arranged and held within an insulating shield case 101. A photosensitive drum 107 is arranged as a recording medium on a front face of the shield case 101. The charger also has a conductive grid electrode 104 having a net shape and arranged in a position opposite to the photosensitive drum 107. The conductive grid electrode 104 is used to charge a surface of the photosensitive drum 107.

A charger described in U.S. Pat. No. 4,725,731 has a means for supporting the saw-toothed electrode 102 in the charging structure shown in FIG. 1. An open portion is included in this supporting means to form a corona-like flow as a result of a corona discharge. In this charger, ozone caused by the corona discharge is collected within the shield case 101 causing charging irregularities by deterioration of the photosensitive drum 107 and the saw-toothed electrode 102, etc. The corona flow is generated so as to prevent such charging irregularities with the ozone being discharged from the shield case.

A charger described in U.S. Pat. No. 4,725,732 shows a structure for supporting the saw-toothed electrode 102 and the shield case 101 by the same supporting member in the charging structure shown in FIG. 1.

In a charger described in U.S. Pat. No. 4,792,680, beryllium copper is used as the grid electrode 104 to stabilize discharging performance irrespective of a life of the charger.

As mentioned above, in the charger 100 having the charging structure as shown in FIG. 1, a predetermined voltage is applied by a power source 105 to each of the saw-toothed electrodes 102 and 103. A grid voltage Vg for controlling a corona electric current is applied by a power source 106 to the grid electrode 104. The corona electric current is discharged from a tip portion of each of the saw-toothed electrodes 102 and 103 onto a surface of the photosensitive drum 107. At this time, an electric current flowing through each of the saw-toothed electrodes 102 and 103 comprises a total electric current It. An electric current flowing through the grid electrode 104 is a grid current Ig.

In the charger 100 shown in FIG. 1, a surface of the photosensitive drum 107 is uniformly charged by corona discharge in an axial direction of the drum. A charging condition is slightly changed in accordance with various conditions of the corona discharge. When the charging condition is changed, charging irregularities on the surface of the photosensitive drum 107 are caused so that the quality of an original image to be formed is influenced by the charging irregularities.

A method for increasing a total electric current It flowing through the saw-toothed electrodes 102 and 103 is generally considered as a simple method for reducing these charging irregularities. However, when the total electric current It is increased, it is necessary to increase a voltage applied to the saw-toothed electrodes 102 and 103. A discharging electric current is increased when the voltage applied to the saw-toothed electrodes 102 and 103 is increased. Therefore, an amount of ozone generated from a discharging portion is increased so that the surface of the photosensitive drum 107 is influenced by this ozone, thereby reducing the quality of an original image.

When the amount of ozone is increased, this ozone is bonded to various gases and foreign materials in the air floating within an image forming apparatus so that nitrogen oxides ($NO_X$), silicon oxides ($SiO_2$), etc. are generated. These oxides are attached onto surfaces of the saw-toothed electrodes and the grid electrode so that discharging ability of the saw-toothed electrodes and ability for controlling a charging potential of the grid electrode are reduced.

Further, it is necessary to prevent leakage discharge from the tip portions of the saw-toothed electrodes 102 and 103 to other unnecessary portions as a result of an increase in applied voltage V by increasing the total electric current It. To prevent this leakage discharge, it is necessary to establish relatively large distances from discharging portions of the saw-toothed electrodes 102 and 103 to the shield case 101. Therefore, the shield case 101 is made large-sized so that the charger 100 results in being large-sized.

Figure 2:
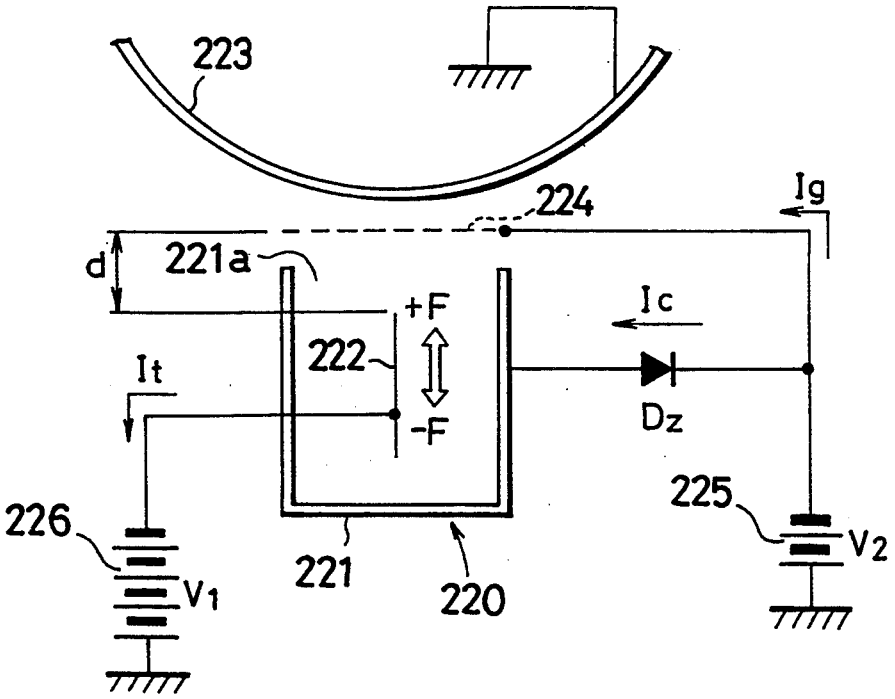
Fig. 2 PRIOR ART
FIG. 2 is a schematic diagram for explaining a prior art charger having a saw-toothed electrode.

FIG. 2 is a view for explaining a general charger having a saw-toothed electrode. In FIG. 2, reference numerals 220, 221 and 222 respectively designate a charger, a charger case and a saw-toothed electrode. Reference numerals 223 and 224 respectively designate a photosensitive drum and a grid electrode. Further, each of reference numerals 225 and 226 designates a power source.

In FIG. 2, the charger 220 is composed of the charger case 221 and the saw-toothed electrode 222. The saw-toothed electrode 222 is electrically insulated and fixed to an inner central portion of the charger case 221. The charger case 221 is constructed by an elongated metallic plate having a U-shape in cross section and one opening end 221*a*. The saw-toothed electrode 222 is constructed by a metallic plate having a sharp tip portion saw-toothed toward the opening portion 221a of the charger case 221. A negative voltage $V_2$ from the power source 225 is applied to the charger case 221 through a Zener diode $D_z$. A negative voltage $V_1$ from the power source 226 is lower than the voltage $V_2$ and is directly applied to the saw-toothed electrode 222. An inner circumferential wall of the photosensitive drum 223 is connected to the ground and is opposed to the opening portion 221*a* of the charger 220. The grid electrode 224 is arranged between the photosensitive drum 223 and the charger 220. A distance d between the photosensitive drum 223 and the sharp tip portion of the saw-toothed electrode 222 is set to be constant. The grid electrode 224 is connected to the power source 225 having the negative voltage $V_2$.

In the above charger 220, a potential difference of a constant voltage magnitude determined by the Zener diode $D_z$ is provided between the charger case 221 and the grid electrode 224. A voltage of the charger case 221 is held such that this voltage is lower by the potential difference than the voltage $V_2$ of the power source 225. The lower voltage $V_1$ is applied to the saw-toothed electrode 222 from the power source 226. Corona discharge is caused from the saw-toothed electrode 222 toward the photosensitive drum 223 so that the photosensitive drum 223 is charged with ionic charges. At this time, an electric current of the saw-toothed electrode 222 is set to It.

The charger 220 delivers uniform charges onto a surface of the photosensitive drum 223 by the corona discharge. The corona discharge is influenced by an external environment such as atmospheric pressure, temperature, humidity, etc. Further, the electrode current It is changed by wearing of a tip portion of the saw-toothed electrode 222 so that no photosensitive drum 223 is uniformly charged with ionic charges. The change in electrode current It causes a change in impedance between the saw-toothed electrode 222 and the photosensitive drum 223.

A grid current Ig and a case current Ic respectively flow through the grid electrode 224 and the charger case 221 by the corona discharge from the saw-toothed electrode 222. A ratio of the grid current Ig and the case current Ic constitutes an impedance ratio and is constant in a normal operating state. However, this impedance ratio is changed in accordance with the above external environment and operating states of the electrodes.

The saw-toothed electrode 222 is separated by the constant distance d from the grid electrode 224 and is fixed in position with respect to the photosensitive drum 223. Accordingly, when the impedance ratio is changed, charges on the photosensitive drum 223 are not uniform and any lack of uniformity on charges cannot be corrected for in prior art chargers.

Figure 3:
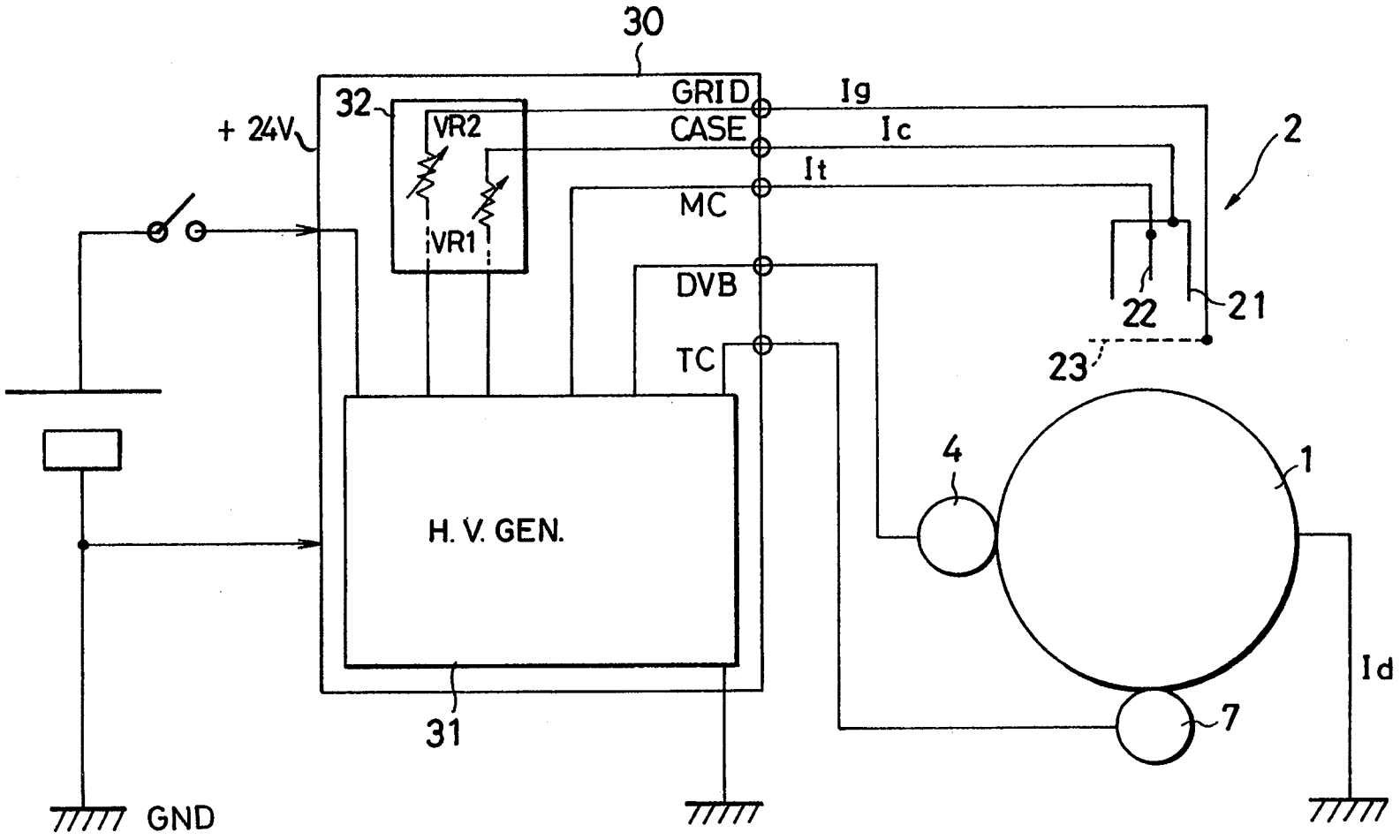
FIG. 3 is an electrical block diagram showing a power supply circuit including a high voltage generating circuit for applying a voltage to a charger in accordance with the present invention.
Figure 4:
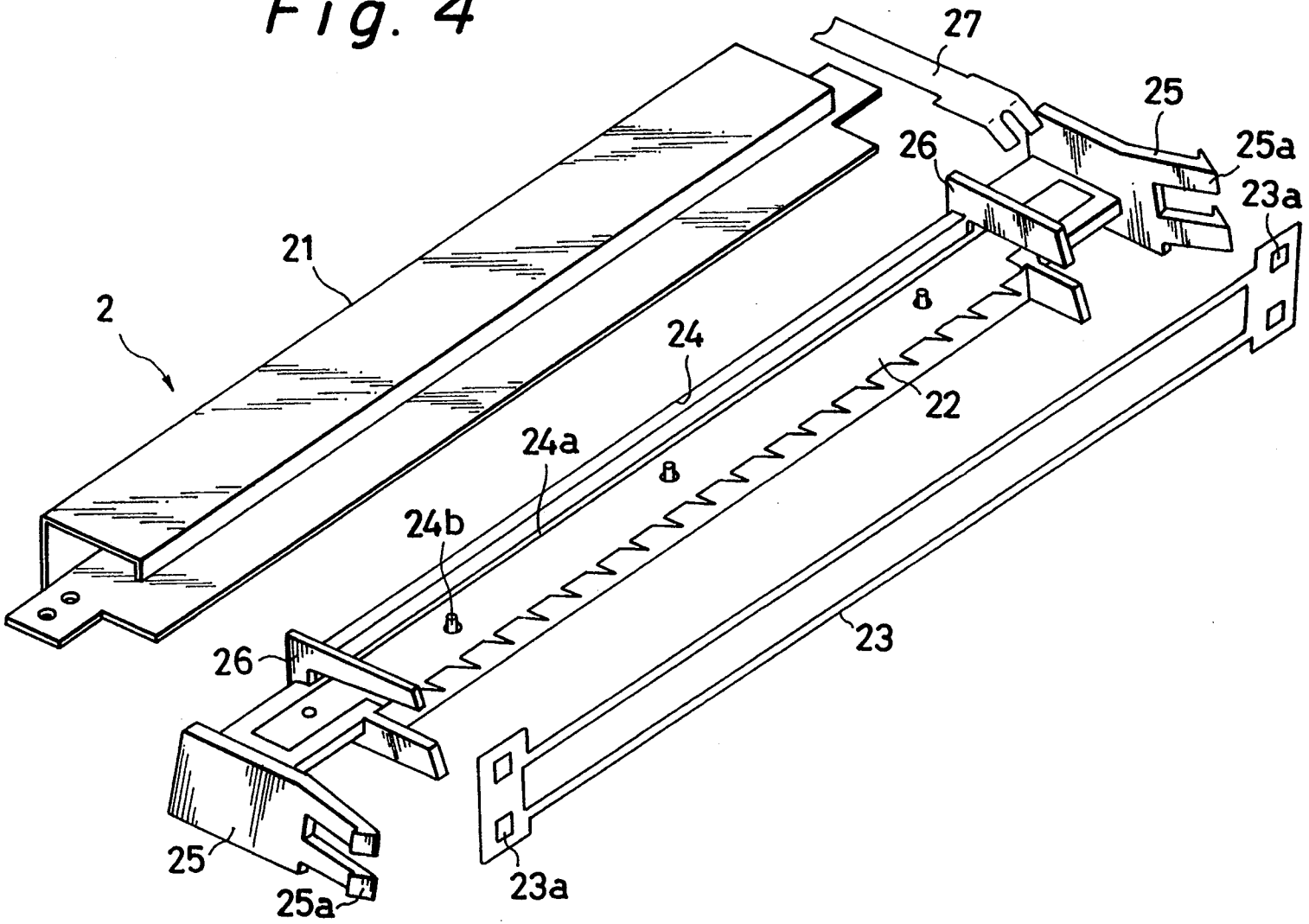
FIG. 4 is an exploded perspective view showing an entire structure of a charger in accordance with the present invention.
Figure 5:
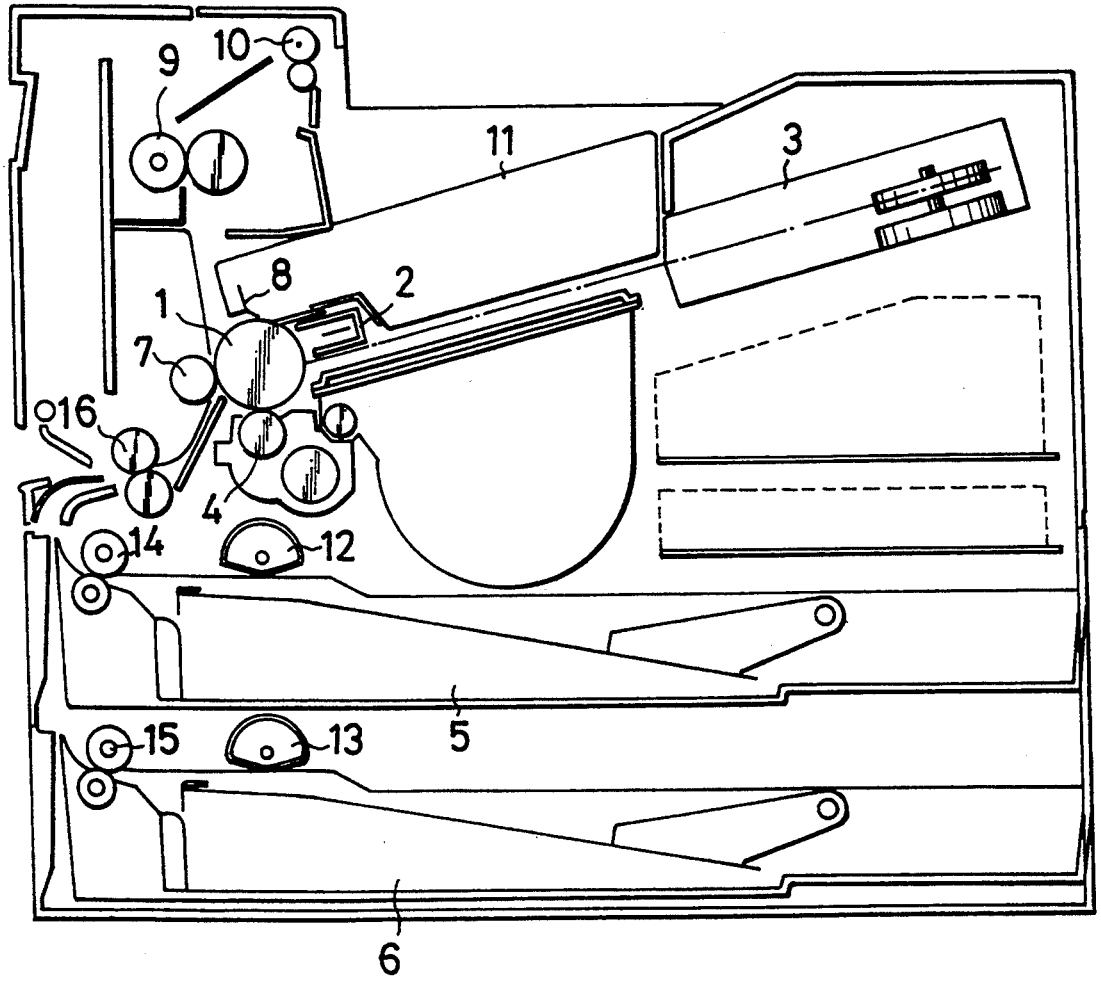
FIG. 5 is a cross-sectional view showing the internal structure of an image forming apparatus having the charger in accordance with the present invention.

FIG. 3 is a block diagram showing a power supply circuit including a high voltage generating circuit 31 for applying a voltage to a charger 2 in accordance with the present invention. FIG. 4 is an exploded perspective view showing a structure of the charger in accordance with the present invention. FIG. 5 is a cross-sectional view showing the internal structure of an image forming apparatus such as a laser printer including a the charger in accordance with the present invention.

In the image forming apparatus shown in FIG. 5, a photosensitive drum 1 is arranged in a central portion on a left-hand side of the image forming apparatus. For example, the photosensitive drum 1 is formed by using a layer of an organic photo conductor (OPC) as a photoconductive layer on an aluminum drum as described before. Each of constructional units for forming an electrophotographic process is arranged around this photosensitive drum 1 as a center such that these constructional units are opposed to the photosensitive drum 1. A charger 2 in accordance with the present invention is arranged around the photosensitive drum 1 and uses corona discharge for uniformly charging the photosensitive drum 1. An optical recording section 3 irradiates a laser beam for exposing and recording an original image onto a surface of the photosensitive drum 1 uniformly charged by the charger 2. A developing device 4 develops an electrostatic latent image formed on the photosensitive drum 1 by the optical recording section 3 by using toner. A transfer device 7 transfers a toner image formed on the photosensitive drum 1 by the developing device 4 onto a surface of a transfer material such as paper fed from one of paper storing sections 5 and 6. A cleaner 8 removes and collects residual toner partially left on the photosensitive drum 1 without transfer of the toner image from the photosensitive drum 1 to the transfer material by the transfer device 7.

The toner image as an original image transferred onto the transfer material by the transfer device 7 is fed to a fixing heater 9 and is fixed onto the transfer material by heat and pressure. Thus, the transfer material having the toner image is discharged through a paper discharging roller 10 onto a paper discharging tray 11 in an upper portion of the image forming apparatus.

The paper storing sections 5 and 6 are detachably disposed in a body of the image forming apparatus. Paper feed rollers 12 and 13 are respectively opposed to the paper storing sections 5 and 6. The transfer material fed by each of the paper feed rollers 12 and 13 is fed toward a resist roller 16 by each of conveying rollers 14 and 15. The resist roller 16 temporarily stops a movement of the fed transfer material and controls a starting operation of conveyance of the transfer material in synchronization with rotation of the photosensitive drum 1. In particular, the resist roller 16 controls the starting operation of conveyance of a piece of paper such that a front end of the image formed on the photosensitive drum 1 is in conformity with a front end of the transfer material.

As noted above, FIG. 4 shows one example of a structure of the charger 2 in accordance with the present invention. The charger 2 includes a conductive shield case 21, a saw-toothed electrode 22, a grid electrode 23 and an insulating electrode holding member 24 for holding various kinds of electrodes.

In FIG. 4, the shield case 21 is comprised of a conductive shield plate having a length approximately equal to a width of the photosensitive drum 1 in the direction of a rotational axis thereof. The shield case 21 is opened on a side opposite to a surface of the photosensitive drum 1. The saw-toothed electrode 22 has a plurality of sharp projections for discharge arranged in line at a predetermined pitch. The saw-toothed electrode 22 is fabricated by a thin plate formed in the shape of a short strip and made of stainless steel such as an alloy of ion, chromium and nickel. For example, this alloy is constructed by SUS304 in Japanese Industrial Standard (JIS). Such a saw-toothed electrode 22 is formed by etching processing.

The saw-toothed electrode 22 has a plurality of openings for fixing the saw-toothed electrode 22. Each of these openings is fitted onto a projecting portion 24b formed in a planar shape portion 24a of the electrode holding member 24 integrally formed by an insulating member. Thus, the saw-toothed electrode 22 is positioned, fixed and held by the shield case 21 in an electrically insulated state in the planar shape portion **24*a* of the electrode holding member A grid electrode holding portion 25 is integrally formed in the electrode holding member 24. The grid electrode holding portion 25 electrically insulates and holds the grid electrode 23 with respect to the shield case 21 and the saw-toothed electrode 22. This grid electrode holding portion 25 has an engaging portion 25*a* including a hook portion for engagement and corresponding to an opening portion 23*a* formed at each of both ends of the grid electrode 23. When this grid electrode holding portion 25 is elastically deformed, the engaging portion 25*a* is inserted into the opening portion 23*a* of the grid electrode 23. When this elastic deformation of the grid electrode holding portion 25 is released, the grid electrode 23 snaps into place and is held by the elastic force of the grid electrode holding portion 25** as predetermined tensile force.

The above grid electrode 23 has openings having a mesh shape, not shown, and is uniformly formed by etching a thin plate. This thin plate is formed in the shape of a short strip and is made of stainless steel as in the above saw-toothed electrode 22. The grid electrode holding portion 25 integrally molded with the electrode holding member 24 is elastically deformed so that the engaging portion **25*a* is inserted into an opening formed in the grid electrode 23 and is engaged with this opening. Thus, the grid electrode holding portion 25** is tensioned by an elastic force.

A positioning member 26 is integrally molded with the electrode holding member 24 and is arranged in accordance with each of both end edges of the shield case 21. The positioning member is used to position the electrode holding member 24 within the shield case 21.

When a corona discharger having such a structure is assembled, a projection of the planar shape portion **24*a* of the electrode holding member 24 is first fitted into an opening formed in the saw-toothed electrode 22 so that the saw-toothed electrode 22 is held by this projection. The positioning member 26 is positioned and stored at an end edge of the shield case 21 in a predetermined position within the above shield case 21 in a state in which the saw-toothed electrode 22 is held. The engaging portion 25*a* of the grid electrode holding portion 25 is inserted into the opening portion 23*a* of the grid electrode 23 and is engaged with this opening portion 23*a*. A spring terminal 27 for power supply electrically comes in elastic contact with a tip portion of the saw-toothed electrode 22 located in the electrode holding member 24** and projected from the shield case.

In the charger 2 having electrical circuitry, as shown in FIG. 3, predetermined voltages are applied to the respective electrodes and the shield case 21 from a power supplying circuit 30.

In FIG. 3, a predetermined voltage of +24 V is supplied to the power supply circuit 30. A high voltage generating circuit 31 is disposed within the power supplying circuit 30. The high voltage generating circuit 31 converts the supplied voltage +24 V to a predetermined voltage and outputs the converted voltage therefrom. This high voltage generating circuit 31 also generates voltages supplied to the shield case 21, the saw-toothed electrode 22 and the grid electrode 23 in the charger 2 of the present invention. Further, the high voltage generating circuit 31 generates a developing bias supplied to the developing device 4, a voltage supplied to the transfer device 7, etc. These generating voltages are outputted as predetermined voltages from respective output terminals of the power supplying circuit 30. As will be explained later, a voltage adjusting circuit 32 is additionally disposed in the power supplying circuit 30 and adjusts voltages generated from the high voltage generating circuit 31 when the power supplying circuit 30 supplies voltages to the shield case 21 and the saw-toothed electrode 22 in the charger 2.

The saw-toothed electrode 22 in the charger 2 is connected to an output terminal MC of the power supplying circuit 30 and receives a high voltage V from the power supplying circuit 30. The shield case 21 is connected to an output terminal CASE of the power supplying circuit 30 and receives a high voltage Vc from the power supplying circuit 30. Further, the grid electrode 23 is connected to an output terminal GRID of the voltage adjusting circuit 32 and receives a high voltage Vg from the voltage adjusting circuit 32. The voltage adjusting circuit 32 has a variable resistor VR1 for adjusting an output voltage supplied from the output terminal CASE to the shield case 21. The voltage adjusting circuit 32 also has a variable resistor VR2 for adjusting an output voltage supplied from the output terminal GRID to the grid electrode 23.

Various kinds of voltages are supplied to the charger 2 by the power supplying circuit 30 having the above construction so that corona discharge is caused from a projecting tip portion of the saw-toothed electrode 22. A total electric current It, caused by this corona discharge, flows through the saw-toothed electrode 22. A portion of the electric current It caused by the corona discharge also flows onto a side of the photosensitive drum 1 so that a surface of the photosensitive drum 1 is charged with electricity having a specified polarity. At the same time, a discharging electric current flows through the photosensitive drum by the corona discharge; however, but a charging potential of the photosensitive drum 1 is especially determined in accordance with the electric current flowing through the photosensitive drum. A drum current Id flowing through this photosensitive drum 1 can be controlled by controlling a voltage supplied to the grid electrode 23 so that a surface potential of the photosensitive drum 1 can be controlled and set to a predetermined potential. In this case, a grid current Ig flowing through the grid electrode 23 can be adjusted by suitably setting the output voltage of the output terminal GRID using the variable resistor VR2 of the adjusting circuit 32. Similarly, a case electric current Ic caused by the corona discharge flows through the shield case 21. The case electric current Ic can be also controlled by adjusting the output voltage of the output terminal CASE using the variable resistor VR1.

The total electric current It is provided by the corona discharge caused by supplying a high voltage to the saw-toothed electrode 21. This total electric current It is equal to a sum of the case electric current Ic, the grid current Ig and the drum current Id respectively flowing through the shield case 21, the grid electrode 23 and the photosensitive drum 1. Namely, the total electric current It flowing through the saw-toothed electrode 21 by the corona discharge is distributed and flows through the shield case 21, the grid electrode 23 and the photosensitive drum 1. The total electric current It is distributed or divided into the case electric current Ic, the grid current Ig and the drum current Id and is represented by the following expression:

$$It = Ic + Ig + Id \quad (1)$$

Accordingly, when the total electric current It is set to a constant value, the drum current Id flowing through the photosensitive drum 1 is set at a constant value so that the surface potential of the photosensitive drum 1 is controlled and set to a constant potential. Therefore, similar to the general charger, the charger 2 has a constant current control section for constantly controlling the total electric current in the high voltage generating circuit 31 of the power supplying circuit 30.

In the present invention, it is desirable to have uniform discharging characteristics of the saw-toothed electrode 22 located in parallel with an axial direction of the photosensitive drum 1 so as to uniformly charge the entire surface of the photosensitive drum 1 in a rotational axis thereof. Therefore, the charging surface potential of the photosensitive drum 1 is measured along the axial direction thereof when the photosensitive drum 1 is charged with electricity by the charger 2, thereby having a knowledge of the charging characteristic state of the photosensitive drum.

Figure 6:
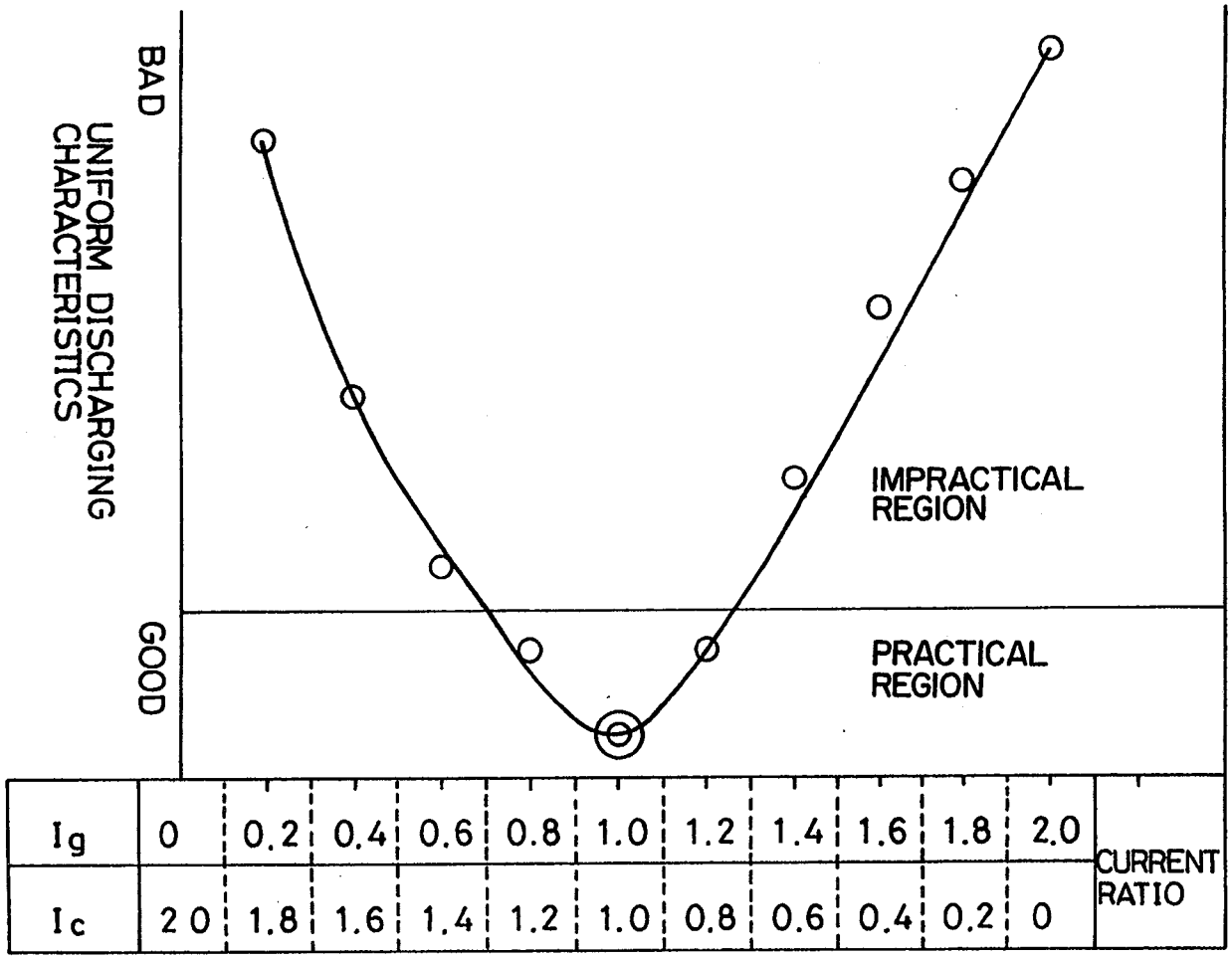
FIG. 6 is a characteristic curve helpful in explaining the relation between an electric current distribution ratio and discharging characteristics on a surface of a photosensitive drum in the present invention, and evaluating uniform discharging characteristics on the photosensitive drum surface by changing a ratio of a grid current and a case electric current.

FIG. 6 is a characteristic curve illustrating the charging characteristics of the charger in the present invention. This graph illustrates the relation between discharging characteristics and a current distribution ratio of the case electric current Ic and the grid current Ig. The axis abscissa of this graph shows the current distribution ratio of the case electric current and the grid current. The ordinate axis of this graph shows the discharging characteristics on the photosensitive drum as an image carrier.

As can be seen from the characteristic graph in FIG. 6, uniform discharging characteristics are very bad when the case electric current Ic and the grid current Ig are significantly different from each other and the current distribution ratio is large. In this case, discharging irregularities are caused on the photosensitive drum surface so that the quality of a recorded image is influenced by the discharging irregularities.

In contrast to this, when the case electric current Ic and the grid current Ig are approximately equal to each other, there are almost no discharging irregularities on the photosensitive drum surface. Accordingly, the photosensitive drum surface is uniformly charged and the quality of the recorded image is improved. When the case electric current Ic and the grid current Ig is especially equal to each other (1.0:1.0) and the current distribution ratio is equal to one, the corona discharging characteristics are very stabilized so that the photosensitive drum surface can be desirably charged uniformly.

The photosensitive drum 1 is desirably charged uniformly in at least a range of the current distribution ratio of the case electric current Ic and the grid current Ig from 0.7:1.3 to 1.3:0.7. In this region, the case electric current Ic and the grid current Ig are sufficiently close to each other to provide a practical operating region.

In the discharging characteristics shown in FIG. 6, when the current distribution ratio of the case electric current Ic and the grid current Ig is set in the above noted practical region, no black and white stripes can be seen as image irregularities with the naked eye. In contrast to this, in an impractical region, as shown in FIG. 6, the black and white stripes can be seen as image irregularities with the naked eye.

With respect to the grid current Ig and the case electric current Ic, for example, a grid voltage Vg is fixedly set to a constant voltage such as −600 V and a case voltage Vc is adjusted by suitably adjusting a resistance value of the variable resistor VR1. At this time, values of the grid current Ig and the case electric current Ic respectively flowing through the grid electrode and the shield case are measured. Charging characteristics at the current distribution ratio at this time are also shown in FIG. 6. At this time, the case voltage Vc is changed between 0 V and 1.5 kV.

In the following experiments, the above charger is located in one image forming apparatus.

In a first experiment, an image forming apparatus shown in FIG. 5 is set in a laser printer in which a rotational circumferential speed of the photosensitive drum 1 is set to 50 mm/second as a processing speed. A high voltage V applied to the saw-toothed electrode 22 is set to about −3.4 kV. At this time, a total electric current. It flowing through the saw-toothed electrode 22 is equal to −300 μA. Resistance values of the variable resistors VR1 and VR2 are adjusted such that a grid current Ig flowing through the grid electrode 23 and a case electric current Ic flowing through the shield case 21 are equal to each other. At this time, a voltage Vc of the shield case 21 is equal to −600 V and a voltage Vg supplied to the grid electrode 23 is equal to −500 V. Optimum uniform discharging characteristics on the photosensitive drum 1 are obtained when each of the case electric current Ic and the grid current Ig is substantially equal to −145 μA.

These experimental data obtained in the first experiment by using the image forming apparatus are used in the above formula (1) so that the following formula is obtained.

$$It(300\ \mu A)=Ic(145\ \mu A)+Ig(145\ \mu A)+Id$$

At this time, the drum current Id is equal to 10 μA.

From the above results, the case electric current Ic flows through the shield case 21 by applying the high voltage Vc to the shield case of the charger 2. Further, the grid current Ig flows through the grid electrode 23 by applying the high voltage Vg to the grid electrode 23. At this time, the resistance values of the variable resistors VR1 and VR2 in the above voltage adjusting circuit 32 are preferably adjusted and set to provide these voltages Vc and Vg such that the case electric current Ic and the grid current Ig are approximately equal to each other.

As mentioned above, the most desirable results of the uniform discharging characteristics are obtained when the grid current Ig and the case electric current Ic are set to be equal to each other (1:1). A life of each of the above electrodes, an environment for arranging the charger 2, etc. can be considered with respect to the discharging characteristics of the charger 2. In this case, as can be seen from the characteristic graph in FIG. 6, the above current distribution ratio is desirably set in the practical region wherein the grid current Ig and the case electric current Ic are substantially close to each other. As mentioned above, in this practical region, the grid current Ig and the case electric current are respectively set in a region ranged from 0.7:1.3 to 1.3:0.7.

Figure 7:
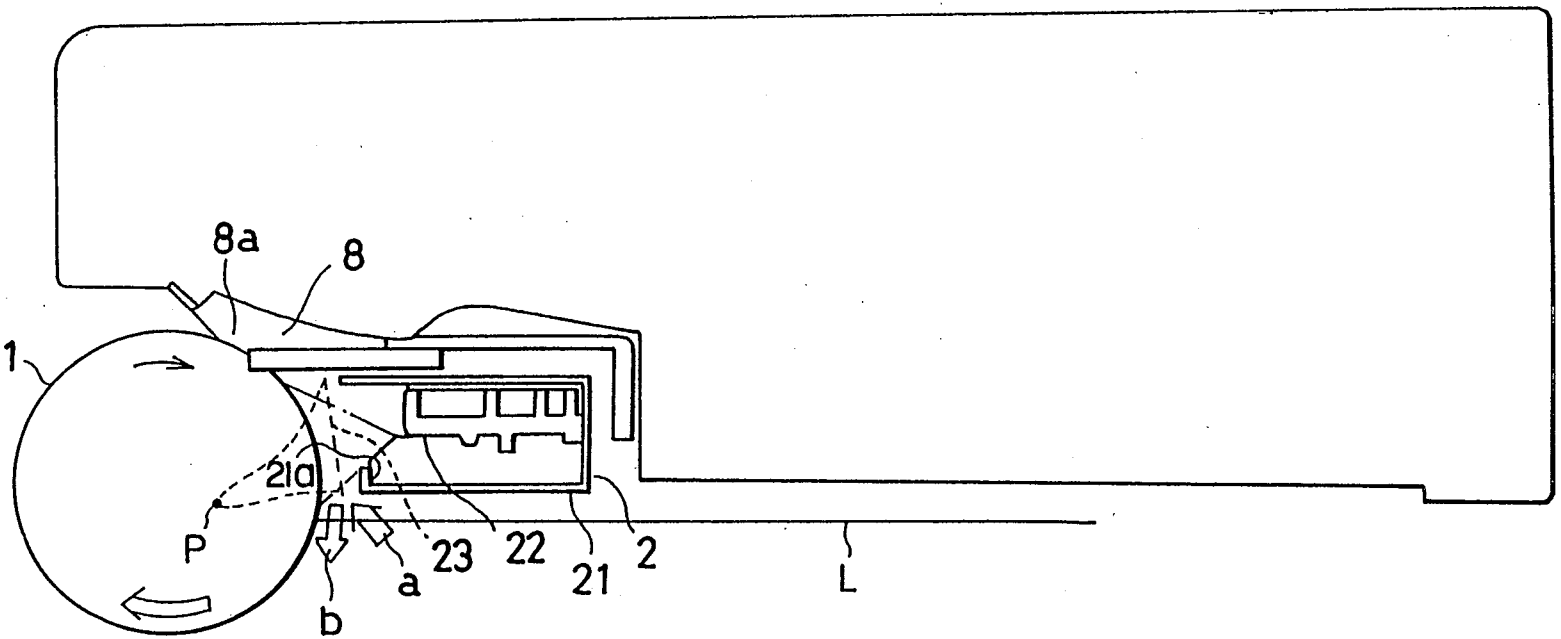
FIG. 7 is an enlarged side elevational view of a main portion including the charger of the present invention shown in FIG. 5.

FIG. 7 is an enlarged view showing the charger 2 and the cleaner 8 in an electrophotographic processing section arranged around the photosensitive drum 1 in FIG. 5. The cleaner 8 and the charger 2 in the present invention are sequentially arranged on the upstream side of the photosensitive drum 1 in a rotational direction thereof. A laser optical path L is arranged in a lower portion of this charger 2. A laser beam is irradiated from the optical recording section 3 and is guided onto a surface of the photosensitive drum 1 as an image carrier along the laser optical path L.

In FIG. 7, a corona portion caused by corona discharge from a discharging tip portion of the saw-toothed electrode 22 is discharged toward a surface of the photosensitive drum 1 in a discharging region shown by one-dotted chain line. This discharged corona portion acts on a photoconductive layer of the photosensitive drum 1 through a uniform opening screen of the grid electrode 23. At this time, an amount of the corona portion acting on the photoconductive layer on the surface of the photosensitive drum 1 is set by controlling the grid voltage Vg applied to the grid electrode 23.

A waveform shown by the broken line in FIG. 7 shows a corona discharging portion discharged from the discharging tip portion of the saw-toothed electrode 22. A peak point P of this waveform is illustrative of the desired charging characteristics of the photoconductive layer of the photosensitive drum 1.

Normally, the peak point P of this waveform showing discharging characteristics is located in a region directly opposite to the tip portion of the saw-toothed electrode 22. However, as shown by a case portion **21*a* in FIG. 8, the peak point P of the waveform is deflected in a direction shown by the broken line by bending a lower end 21*a* of the shield case 21 upwards in an L-shape. The L-shaped lower end portion of the shield case 21 approaches and is relatively closer proximity to the tip portion of the saw-toothed electrode 22 in comparison with another case portion 21*b* of the shield case 21. Accordingly, with respect to the waveform of the discharging characteristics shown in FIG. 8, the peak point P is deflected toward a side of the L-shaped lower end portion of the shield case 21 in accordance with a difference in impedance. In particular, corona discharge is caused on a front face of the charger 2 toward a surface of the photosensitive drum 1 from a projection of the saw-toothed electrode This front face is located in front of the one-dotted chain line shown in FIG. 8. Accordingly, it is sufficient to make at least the portion 21*a* of the shield case 21 conductive. The case portion 21*b*** may also be made conductive.

In this explanation, the end portion **21*a* of the shield case 21 is partially bent in an L-shape to change impedances between this end portion and the other case portions. However, there is also a involved for changing an impedance between this case end portion and another discharging portion. In this method, an internal face of the shield case 21 is partially coated with a coating film, or the material of the shield case is partially changed. Desired charging characteristics of the photoconductive layer of the photosensitive drum 1** can be obtained by using this method.

The corona discharge portion from the tip portion of the saw-toothed electrode 22 is desirably formed at a position where there are no regions for other processing which would be normally influenced by this corona portion. However, when an image forming apparatus is gradually made compact, there is no space for sufficiently arranging processing portions around the photosensitive drum 1. Therefore, it is necessary to arrange these processing portions in relatively close proximity to each other.

Accordingly, a portion of the shield case 21 in the charger 2 is bent as above so that the peak point P showing discharging characteristics can be easily deflected on a desirable side of the charger on which no regions for the other processing portions or devices are influenced by the corona portion.

When the corona discharge is performed by using the saw-toothed electrode 22, an air flow is generated in a corona discharging direction. A corona discharging portion from the tip portion of the saw-toothed electrode 22 has a flowing direction shown in FIG. 7 so that the air flow is formed in a specified direction. Therefore, the air flow can be deflected in an arbitrary direction by shifting the discharging peak point P using the above-mentioned method in accordance with a constructional arrangement of the charger.

In FIG. 7, reference character a designates an air flow flowing into the charger 2 in accordance with the above discharging characteristics. Reference character "b" designates an air flow flowing out of the charger 2. Ozone generated by the corona discharge of the saw-toothed electrode 22 can be discharged by the air flow "b" from the charger 2. The reasons for this ozone discharge are as follows. The cleaner 8 is arranged in an upper portion of the charger 2. A cleaning blade 8*a* of this cleaner comes in press contact with a surface of the photosensitive drum 1. Accordingly, the air flow caused by the corona discharge is interrupted by this cleaning blade 8*a* so that no generated ozone, etc. are discharged from the shield case 21 along this air flow. In contrast to this, as shown in FIG. 7, there is no member present for interrupting the air flow caused by the corona discharge in a lower portion of the charger 2. Accordingly, ozone generated by the corona discharge can be effectively discharged by directing the air flow toward the peak point P. Further, since the lower portion 21*a* of the shield case 2 is bent in an L-shape on an inner side thereof, a distance between the shield case 2 and the photosensitive drum 1 is increased in this bent portion so that the air flow can be effectively discharged from the charger 2.

Figure 8:
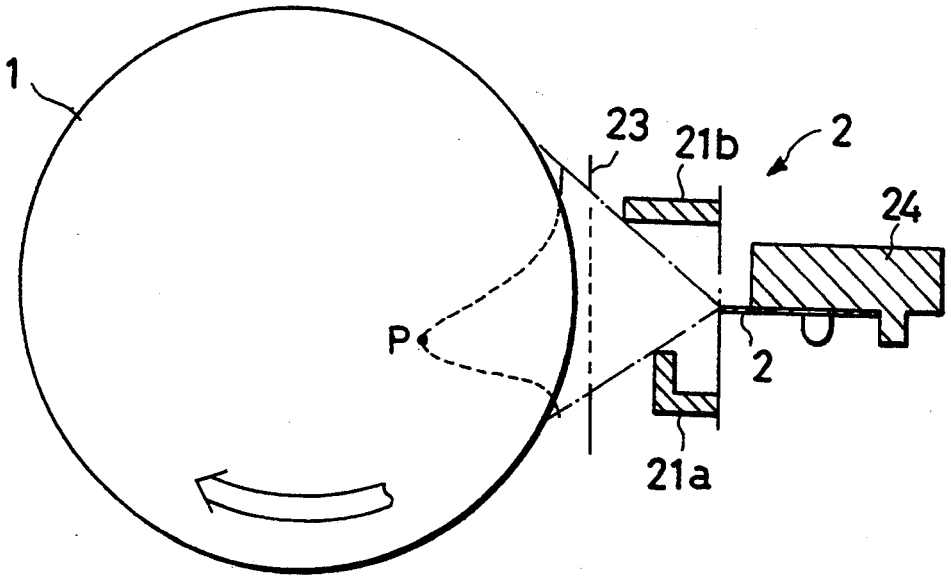
FIG. 8 is an enlarged side elevational view further illustrating a portion of the charger in the present invention shown in FIG. 7.

In a second experiment, the image forming apparatus shown in FIG. 5 is located in an electrophotographic copying machine in which a rotational circumferential speed of the photosensitive drum 1 is set to 200 mm/second as a process speed. A high voltage V applied to the saw-toothed electrode 22 is set to about −4.2 kV. At this time, a total electric current It flowing through the saw-toothed electrode 22 is equal to −700 μA. A voltage Vg supplied to the grid electrode 23 is set to −700 V. The shield case 21 is held such that a voltage of the shield case 21 is equal to a ground potential. At this time, a current distribution ratio is adjusted such that a grid current Ig flowing through the grid electrode 23 is equal to −340 μA and a case electric current Ic flowing through the shield case 21 is equal to −340 μA. As shown in FIGS. 7 and 8, this current distribution ratio is adjusted by bending an end tip 21*a* of the shield case 21 such that this end tip 21*a* approaches the saw-toothed electrode 22. The most desirable data of uniform discharging characteristics with respect to a photoconductive layer of the photosensitive drum 1 are obtained by setting the current distribution ratio to 1 as mentioned above.

These experimental data obtained by using the image forming apparatus in the second experiment are used in the above formula (1) so that the following formula is obtained.

$$It(700\ \mu A) = Ic(340\ \mu A) + Ig(340\ \mu A) + Id$$

At this time, the drum current Id is equal to 20 μA. As mentioned above with respect to structure shown in FIG. 8, corona discharge is caused in a specified direction from a tip portion of the saw-toothed electrode 22. Accordingly, it is not necessary to uniformly shield the peripheral portions by the shield case 21 as in a general wire corona discharger. Therefore, as shown in FIG. 8, one auxiliary electrode plate 21*a* is arranged in parallel with a longitudinal direction of the saw-toothed electrode 22 in the discharging tip portion thereof for generating the corona discharge. The auxiliary electrode plate 21*a* is arranged in a region located on the same side of the photosensitive drum 1 as the discharging tip portion of the saw-toothed electrode 22. The auxiliary electrode plate 21*a* is further located within the discharging region from the tip portion of the saw-toothed electrode 22.

Uniform discharging characteristics can be also obtained when only a portion of the auxiliary electrode plate 21*a* is disposed within the corona discharging region from the tip portion of the saw-toothed electrode 22. Accordingly, it is not necessary to entirely cover the saw-toothed electrode with the shield case as shown in FIGS. 5 and 7 so that the construction of the charger can be simplified and the charger can be made compact. If the cleaner 8 is especially located in an upper portion of the charger as shown in FIG. 7, it is sufficient to dispose the auxiliary electrode plate 21*a* in at least a lower portion of the charger. The auxiliary electrode plate 21*b* may be disposed in the upper portion of the charger if other devices are close to the auxiliary electrode plate 21*a* in the lower portion of the charger and there is no other space for arranging the auxiliary electrode plate.

In the above charger, the surface of the recording medium such as the photosensitive drum 1 is uniformly charged. However, this charger can be also used as a discharger for removing residual charges from the recording medium surface. That is, the charger 2 can be used as a discharger for uniformly discharging the photosensitive drum 1. In particular, a corona discharge is generated by applying a backward or reverse voltage to the photosensitive drum 1 to the saw-toothed electrode 22 so as to discharge the photosensitive drum. In this case, the discharging operation can also be similarly performed by applying an alternating voltage to the saw-toothed electrode 22.

As mentioned above, in accordance with the charger embodiment of the present invention, a current distribution ratio is set such that electric currents Ig and Ic flowing through the grid electrode and the shield case, respectively, are approximately equal to each other, thereby uniformly performing a charging operation of the photosensitive drum. Further, the uniform charging operation can be performed without increasing a voltage applied to a discharging electrode. In particular, the voltage applied to the discharging electrode can be reduced so that it is not necessary to excessively secure a distance from a corona discharging portion to the shield case. Further, the shield case can be made compact so that a size of the charger can be reduced.

Further, the direction of the corona flow caused by corona discharge can be controlled by adjusting the electric current flowing through the shield case. Accordingly, the corona flow can be efficiently discharged from the charger without any interruption of other devices.

In particular, a discharging operation can be preferably stabilized for a long time by using the discharger electrode of the present invention irrespective of attachment of whiskers of silicon oxide, etc. caused in proportion to a using time of the discharging electrode. Further, since no discharging operation is easily influenced by erosion of the discharger electrode caused by ions of nitrogen, etc., the discharging operation can be continuously performed stably even when the discharging operation is performed for a long time.

Figure 9:
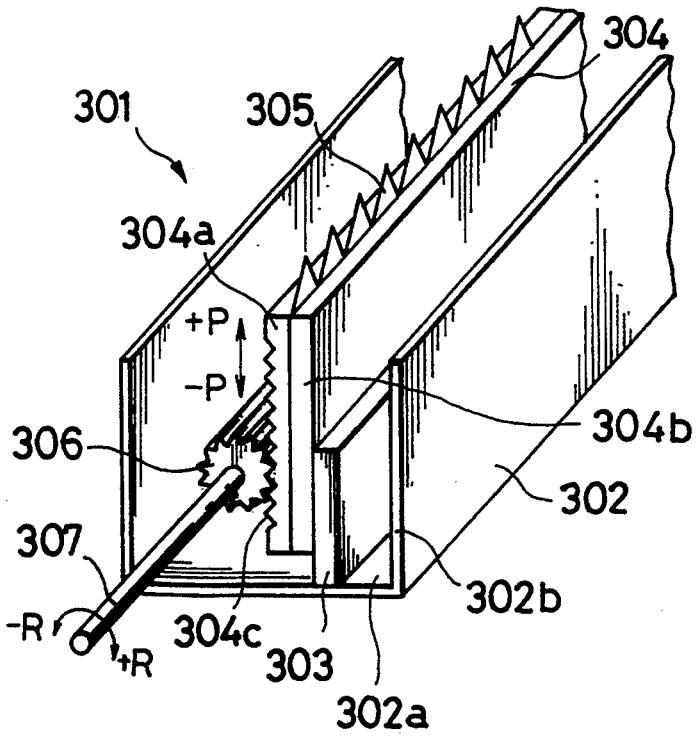
FIG. 9 is a partial perspective view illustrative of a charger in accordance with another embodiment of the present invention.

FIG. 9 is a perspective view for explaining a charger in accordance with another embodiment of the present invention. In FIG. 9, reference numerals 301, 302 and 303 respectively designate a charger, a charger case and a holding member for holding a saw-toothed electrode unit 304. Reference numerals 305, 306 and 307 respectively designate a saw-toothed electrode, a unit driving gear and a gear shaft.

In FIG. 9, the charger case 302 in the charger 301 is constructed by an elongated metallic plate having a U-shape in cross section and an opening upper face. The charger case 302 has a bottom face 302*a* and side faces 302*b*, 302*b*. The saw-toothed electrode unit holding member 303 is constructed by a plate formed in the shape of a short strip. One long side of the holding member 303 is fixed to the charger case 302 in a state in which the holding member 303 is perpendicular to the bottom face 302*a* of the charger case 302 and is parallel to a side face 302*b* of the charger case 302. The saw-toothed electrode 305 has plural sharp ends having the same saw-toothed shape on one side of the elongated metallic plate. The saw-toothed electrode unit 304 is integrally formed by supporting the saw-toothed electrode 305 between insulating plates 304*a* and 304*b*. The saw-toothed electrode unit 304 is held such that the saw-toothed electrode unit 304 can be slidably moved on a face of the saw-toothed electrode unit holding member 303. A rack 304*c* is formed on a non-sliding face of the saw-toothed electrode unit 304 and is engaged with a unitary pinion gear 306. The pinion gear 306 is fixed to the gear shaft 307. When the gear shaft 307 is rotated in the directions of arrows ±R, the saw-toothed electrode unit 304 can be moved in the directions of arrows ±P. Namely, the saw-toothed electrode 305 can be moved forward and backward with respect to an unillustrated photosensitive drum.

Figure 10:
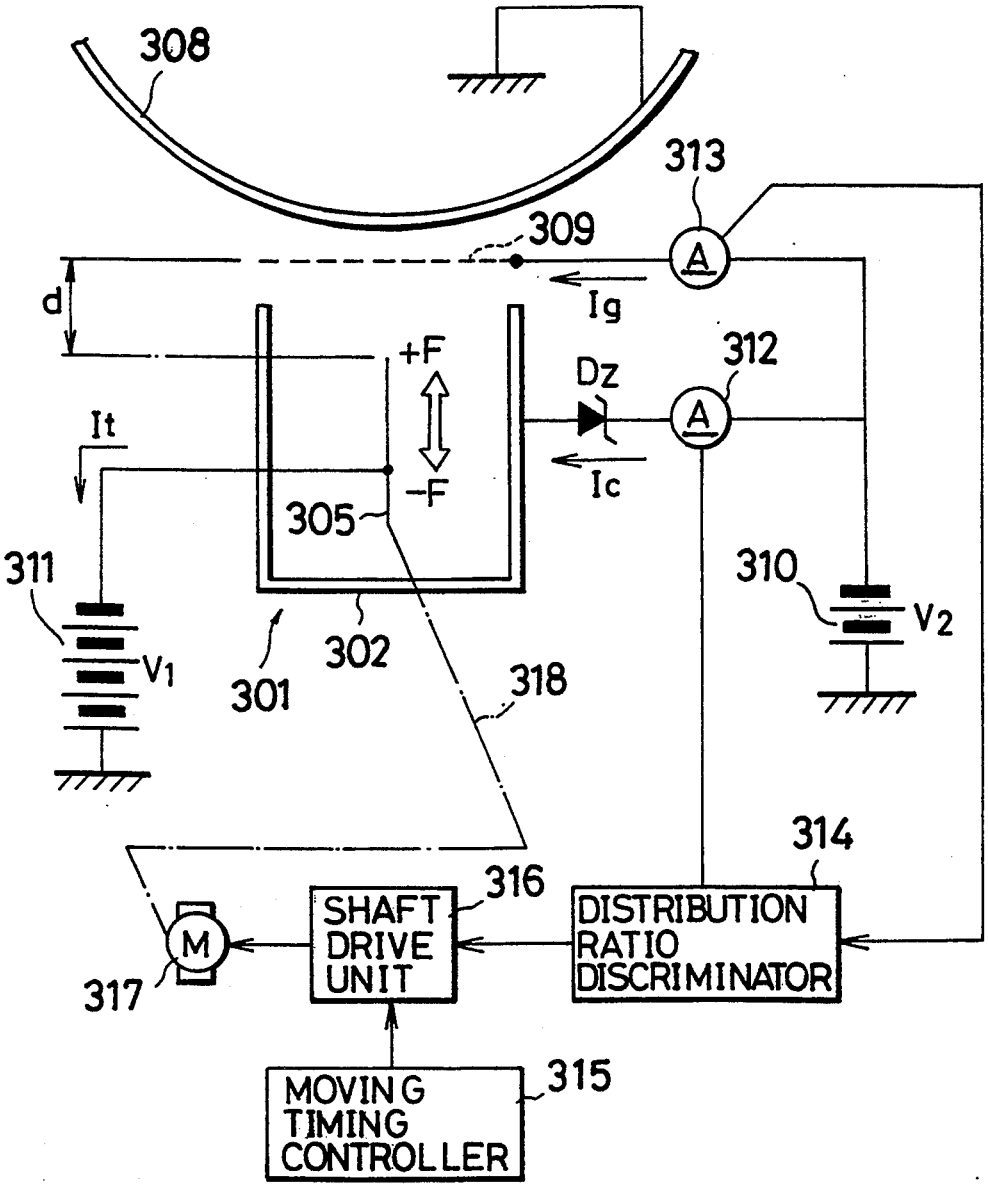
FIG. 10 is an electrical block diagram of a charger in accordance with another embodiment of the present invention.

FIG. 10 is a view for explaining a charger in accordance with the embodiment of the present invention shown in FIG. 9. FIG. 10, reference numerals 308 and 309 respectively designate a photosensitive drum and a grid electrode. Reference numerals 310 and 311 designate power sources. Reference numerals 312, 313 and 314 respectively designate a case electric current detector, a grid current detector and a current distribution ratio discriminator. Reference numerals 315, 316, 317 and 318 respectively designate a timing controller, a shaft drive unit, a drive motor and a driving transmission mechanism. Constructional portions similar to those in FIG. 9 are designated by the same reference numerals as FIG. 9.

In FIG. 10, a charger 301 has an unillustrated drive unit for operating a saw-toothed electrode 305 as shown in FIG. 9. The saw-toothed electrode 305 is opposed to the photosensitive drum 308. The grid electrode 309 is arranged between the photosensitive drum 308 and the charger 301. The grid electrode 309 is separated by a distance d from a sharp tip portion of the saw-toothed electrode 305. The grid electrode 309 is connected to the grid current detector 313 and the power source 310 having a negative voltage $V_2$. A series circuit composed of a Zener diode $D_z$ and the case electric current detector 312 is connected to the charger case 302 and the power source 310. The saw-toothed electrode 305 is connected to the power source 311 having a negative voltage $V_1$ lower than the voltage $V_2$. Outputs of the case electric current detector 312 and the grid current detector 313 are inputted to the distribution ratio discriminator 314. An output of the distribution ratio discriminator 314 is inputted to the shaft drive unit 316. An output of the timing controller 315 is also inputted to the shaft drive unit 316. The shaft drive unit 316 drives the drive motor 317 and moves the saw-toothed electrode 305 through the driving transmission mechanism 318 in the directions of arrows ±F. The driving transmission mechanism 318 has a transmitting function shown by the pinion drive gear 306 and the rack 304*c* in the case of FIG. 9.

An impedance of the charger 301 shown in FIG. 10 is changed by an environmental state between the charger 301 and the photosensitive drum, a change in shape of the sharp tip portion of the saw-toothed electrode 305, etc. The grid current detector 313 and the case electric current detector 312 detect a change in current distribution ratio of the grid current Ig flowing through the grid electrode and the case electric current Ic flowing through the charger case. The detected values of Ig and Ic are inputted to the distribution ratio discriminator 314. The distribution ratio discriminator 314 has an arithmetic circuit for calculating the ratio of the grid current Ig and the case electric current Ic. The distribution ratio discriminator 314 also has a reference signal generating circuit for generating a reference signal as a reference of each of the grid current Ig and the case electric current Ic. The drive motor 317 and the driving transmission mechanism 318 are driven through the shaft drive unit 316 to move the saw-toothed electrode 315 through the driving transmission mechanism 318 such that a difference in voltage between the reference signal and an arithmetic output signal of the arithmetic circuit is set to zero. Thus, the distance d between the saw-toothed electrode 305 and the grid electrode 309 is set such that the current distribution ratio of the grid current Ig and the case electric current Ic is equal to a reference value shown by the reference signal. At this time, a moving period of the saw-toothed electrode 305 is controlled by the moving timing controller 315 such that no saw-toothed electrode 305 is moved while the charger 301 charges the photosensitive drum 308.

In the above explanation, the charger is operated when the charger has a saw-toothed electrode. However, the present invention can be similarly applied to a wire electrode charger.

As mentioned above, in accordance with the present invention, there are instances in which a distribution ratio of the grid current and the case electric current are abnormal as a result of a change in impedance of a charging system caused by damage and wearing of electrodes of the charger, a change in environment such as atmospheric pressure, temperature, humidity, etc. In this invention, however, the current distribution ratio is maintained at an optimum level by partially changing the impedance of the charging system by an operator so that the photosensitive drum can be stably charged.

Many widely different embodiments of the present invention may be resorted to without departing from the spirit and scope of the present invention. It should be understood that the present invention is not limited to the specific embodiments described in the specification, except as defined in the appended claims.

What is claimed is:

1. A charger for charging a recording medium before irradiation of light to form an electrostatic latent image by irradiating light as an optical image onto a surface of said recording medium, said charger comprising:

a discharging electrode having a plurality of projections for generating corona discharge to charge said recording medium surface;

a conductive shield case having an opening face opposite to said recording medium and opposed to said discharging electrode;

a holding member for holding said discharging electrode in said shield case in a state in which said discharging electrode is electrically insulated from said shield case;

a conductive grid electrode electrically insulated from said discharging electrode and said conductive shield and held between said discharging electrode and said recording medium; and a power supplying device for supplying a high voltage for discharge to said discharging electrode and setting a ratio of electric currents flowing through said grid electrode and said shield case such that these electric currents are approximately equal to each other.

2. A charger as claimed in claim 1, wherein said shield case comprises at least one conductive auxiliary electrode plate arranged in parallel with a longitudinal direction of said discharging electrode for charging said recording medium surface, and the auxiliary electrode plate is located in a region on a side of said recording medium with respect to a tip portion of said discharging electrode and is also located within a discharging region of said discharging electrode.

3. A charger as claimed in claim 1, wherein a portion of said shield case is different in structure from other portions of said shield case with respect to said discharging electrode for charging said recording medium surface, and a direction characteristics of a corona discharging to said recording medium surface is deflected in a predetermined direction.

4. A charger in a copying machine of an electrostatic electrophotographic system, said charger comprising:

a photosensitive drum having a uniformly charged face;

a corona discharger electrode for charging said photosensitive drum;

a charger case for electrically insulating and storing said corona discharger electrode;

a grid electrode arranged between said photosensitive drum and said corona discharger electrode;

a power source for supplying respective electric currents to said grid electrode, said charger case and said corona discharger electrode; and means for moving said corona discharger electrode toward said photosensitive drum such that a distribution ratio of electric currents flowing through said grid electrode and said charger case is set to a predetermined value.

5. A charger as claimed in claim 4, wherein said moving means comprises an electrode holding member fixed into the charger case, a movable electrode electrically insulated and held in the electrode holding member such that said movable electrode can be moved with respect to said electrode holding member; and a manual operating device for moving said movable electrode forward and backward on a side of said photosensitive drum.

6. A charger as claimed in claim 5, further comprising a case electric current detector for detecting a case electric current flowing through said charger case, a grid current detector for detecting a grid current, a distribution ratio discriminator for judging whether or not the current distribution ratio of the case electric current and the grid current is equal to a reference value based on detected electric currents of said case electric current detector and said grid current detector, a timing device for generating commands of a period for moving said corona discharger electrode, a shaft drive unit for driving a motor by outputs of said timing device and said distribution ratio discriminator, and a driving transmission mechanism connected to said motor and moving said corona discharger electrode such that said current distribution ratio is set to the reference value.

7. A charger as claimed in claim 4, further comprising a case electric current detector for detecting a case electric current flowing through said charger case, a grid current detector for detecting a grid current, a distribution ratio discriminator for judging whether or not the current distribution ratio of the case electric current and the grid current is equal to a reference value based on detected electric currents of said case electric current detector and said grid current detector, a timing device for generating commands of a period for moving said corona discharger electrode, a shaft drive unit for driving a motor by outputs of said timing device and said distribution ratio discriminator, and a driving transmission mechanism connected to said motor and moving said corona discharger electrode such that said current distribution ratio is set to the reference value.

* * * * *